United States Patent [19]

Hürlemann

[11] 4,240,325

[45] Dec. 23, 1980

[54] BREECHBLOCK FOR AN AUTOMATIC FIRING WEAPON

[75] Inventor: Ernst Hürlemann, Zürich, Switzerland

[73] Assignee: Werkzeugmaschinenfabrik Oerlikon-Bührle, Zürich, Switzerland

[21] Appl. No.: 956,174

[22] Filed: Oct. 30, 1978

[30] Foreign Application Priority Data

Nov. 11, 1977 [CH] Switzerland ..... 13760/77

[51] Int. Cl.[3] ..... F41D 3/00

[52] U.S. Cl. ..... 89/190

[58] Field of Search ..... 89/168, 176, 190

[56] References Cited

U.S. PATENT DOCUMENTS 4,135,434 1/1979 Hürlemann et al. ..... 89/190

*Primary Examiner*—Stephen C. Bentley

*Attorney, Agent, or Firm*—Werner W. Kleeman

[57] ABSTRACT

A breechblock for an automatic firing weapon wherein at the breechblock having a control element and a breechblock head which can be locked at the breechblock housing the locking elements are specially designed. At a front part of each locking element containing the pivot axis of such locking element there is provided a locking surface and at a rear shoulder or projection of each locking element there is provided a support surface beneath which there can engage the control element. Since the locking surface is disposed forwardly with respect to the end of the support surface the path of movement of the breechblock is shortened, and thus, the firing cadence or speed is increased. Furthermore, at the locking elements there are present more favorable force conditions.

1 Claim, 3 Drawing Figures

BREECHBLOCK FOR AN AUTOMATIC FIRING WEAPON

BACKGROUND OF THE INVENTION

The present invention relates to the field of automatic firing weapons, and more specifically, concerns a new and improved construction of breechblock for an automatic firing weapon.

Generally speaking, the breechblock for an automatic firing weapon of the invention is of the type comprising a breechblock housing, a breechblock body displaceable in the breechblock housing and incorporating a breechblock head and a control element. Further, there is provided at least one locking element structured as a single-arm lever and pivotably mounted in the breechblock head and having a locking surface and a support surface. In the forwardmost firing position of the breechblock body the locking surface engages with a latching surface in the breechblock housing and the support surface is engaged by the control element.

A breechblock of this type is disclosed in Swiss Pat. No. 432,298, to which reference may be readily had the disclosure of which is incorporated herein by reference.

SUMMARY OF THE INVENTION

It is a primary object of the present invention to provide a new and improved construction of breechblock which enables achieving an increase of the firing speed or cadence of the weapon and a reduction of the weapon weight.

Now in order to implement these objects and others which will become more readily apparent as the description proceeds, the invention contemplates that the locking element has a front portion or part which contains the pivot axis of such locking element and a rear projection or shoulder. The locking surface is formed at the front part and the support surface at the rear shoulder or projection. The rear edge of the locking surface is arranged in spaced relationship from and in front of the rear end of the support surface.

In the case of a firing weapon wherein the cartridges are laterally fed into the breechblock housing and displaced forwardly into the weapon barrel by the breechblock body the breechblock housing advantageously possesses a shoulder or projection which is directed perpendicular to the vertical longitudinal central plane, and the rear shoulder or projection surface forwardly bounds the opening for infeeding the cartridges. The latch or catch surface in the breechblock housing for locking the breechblock head must be dispositioned, for reasons of strength, by a certain amount in front of the rear projection surface. The spacing of this projection or shoulder surface from the rear end of the weapon barrel therefore is governed by the spacing of the rear edge of the latch surface from such weapon barrel end increased by the additional amount governed by strength considerations. Hence, the size of the spacing of the projection surface from the rear weapon barrel end is together with cartridge length decisive for the length of the path through which moves a cartridge which is displaced by the breechblock body during infeed thereof into the weapon barrel. The magnitude of the displacement path of the breechblock is therefore again in turn decisive for the attainable firing speed or cadence and, thus, also for the length and hence the weight of the weapon.

By means of the inventive breechblock it is possible to reduce the required breechblock path of travel, thereby increasing the firing speed and reducing the weapon weight.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
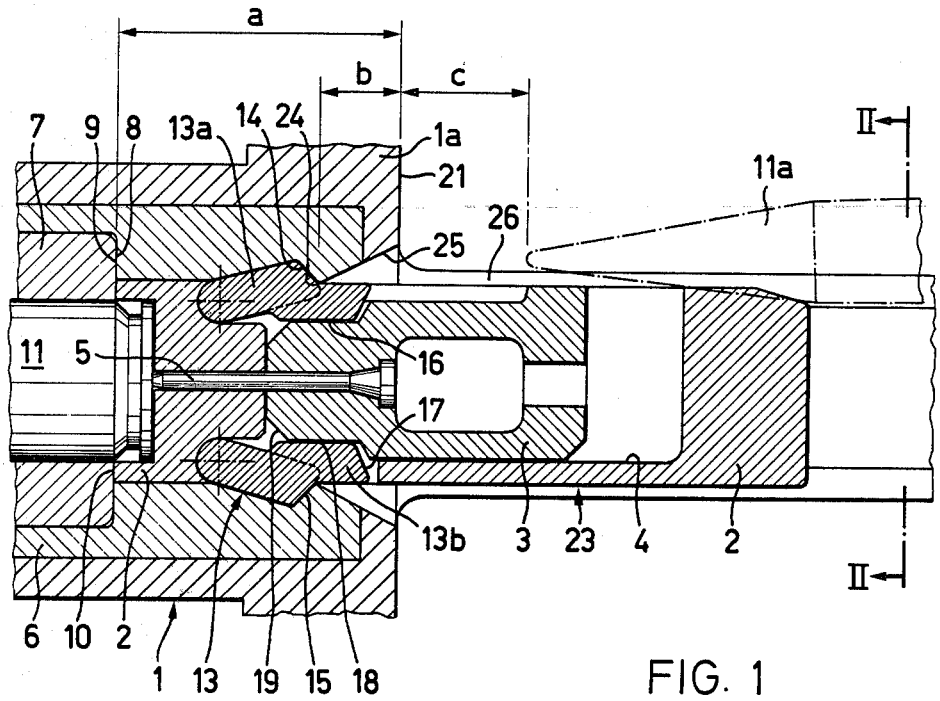
FIG. 1 is a horizontal longitudinal sectional view through a part of a firing weapon equipped with a breechblock body located in a firing position and locking position.

Describing now the drawings, it is to be understood that only enough of the automatic firing weapon containing the inventive breechblock has been shown in the drawings in order to simplify the illustration and to enable those skilled in the art to readily understand the basic principles and underlying concepts of the present development. Turning attention now to FIG. 1, there will be seen that in a breechblock housing 1 of an automatic firing weapon there is displaceably mounted a breechblock body 23. Breechblock body 23 comprises a breechblock head 2 and a control element 3. This control element 3 is inserted into a recess 4 of the breechblock head 2 and is displaceable therein. Attached in the control element 3 is a firing pin 5. The control element 3 is exposed in conventional manner to the pressure of a not particularly illustrated closure spring. Within the breechblock housing 1 there is inserted a locking body 6 and a weapon barrel 7 in known fashion. The rear end surface or end face 8 of the weapon barrel 7 bears at a shoulder 9 of the locking body 6. In the illustrated forwardmost firing position of the breechblock body 23 the breechblock head 2 bears with its front end surface 10 almost at the rear end surface or face 8 of the weapon barrel 7. A cartridge 11, located in the weapon barrel 7, in this position is fired by the firing pin 5.

Figure 3:
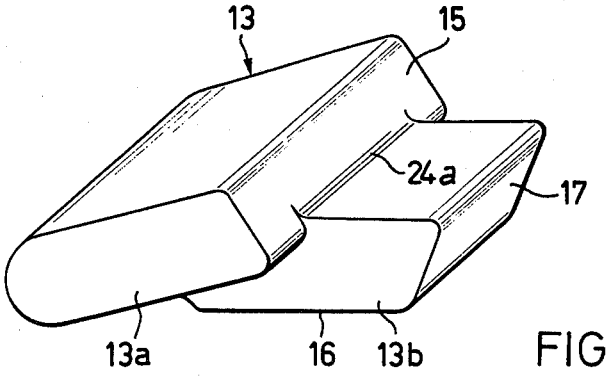
FIG. 3 is a perspective view of a locking element used in the breechblock of the arrangement of FIG. 1.

As is known in this field and thus not further shown, in the breechblock head 2 there are pivotably mounted two locking elements 13 constructed as single-arm levers, for the support of which there are provided catch or latching surfaces 14 at the locking body 6. Such an arrangement has been generally disclosed in the commonly assigned, copending U.S. application of Ernst Hürlemann and Werner Bosshard, Ser. No. 846,913, filed Oct. 31, 1977, to which reference may be readily had and the disclosure of which is incorporated herein by reference. Of course, the latching surfaces 14, also in the absence of the locking body 6, can be directly formed at the breechblock housing 1. The locking elements 13, as also best seen by referring to FIG. 3, each have a front part or portion **13*a* which contains the pivot axis of such locking element and a rear projection or shoulder 13*b*. As equally recognized by further reference to FIG. 3, the more markedly loaded front part or portion 13*a* of the locking element 13 advantageously has a greater width than the rear projection 13*b*. Each locking element 13 i.e., each front part 13*a* is provided with a locking surface 15, which, in the locking position or firing position corresponding to the showing of FIG. 1, engages with the related latching surface 14 of the locking body 6 of the breechblock housing 1. In FIG. 1 reference character 24 designates the rearmost edge of the latching surface 14. By referring to FIG. 3 there will be seen the rear edge 24***a* of the locking surface 15 at the locking element 13.

Continuing, it will be observed that the locking elements 13 have support surfaces 16 and impact surfaces 17 coacting with the control element 3. The control element 3, in turn, is provided with appropriate support surfaces 18 and impact or stop surfaces 19. Although the known coaction of the impact or stop surfaces 17 and 19 has not been particularly shown in the drawings, nonetheless FIG. 1 shows that in the locking or firing position the support surfaces 16 of the locking elements 13 are engaged therebelow by the support surfaces 18 of the control element 3. The rear edge 24*a* of the locking surface 15 is dispositioned in spaced relationship from and forwardly of the rear end of the support surface 16 closer to the locking element-pivot axis.

The breechblock housing 1 is provided with a shoulder or projection 1*a* directed perpendicular to the lengthwise axis of the weapon. The rear shoulder surface 21 of this shoulder or projection 1*a* has a spacing a from the rear end surface or face 8 of the weapon barrel 7 which is mounted in the breechblock housing 1. The rearmost edge 24 of the latching surface 14 is spaced by an amount b from such shoulder surface 21, and between this edge 24 and the shoulder surface 21 there is formed an inclined or beveled guide surface 25 for cartridges 11*a* in the locking body 6 and in the breechblock housing 1.

Figure 2:
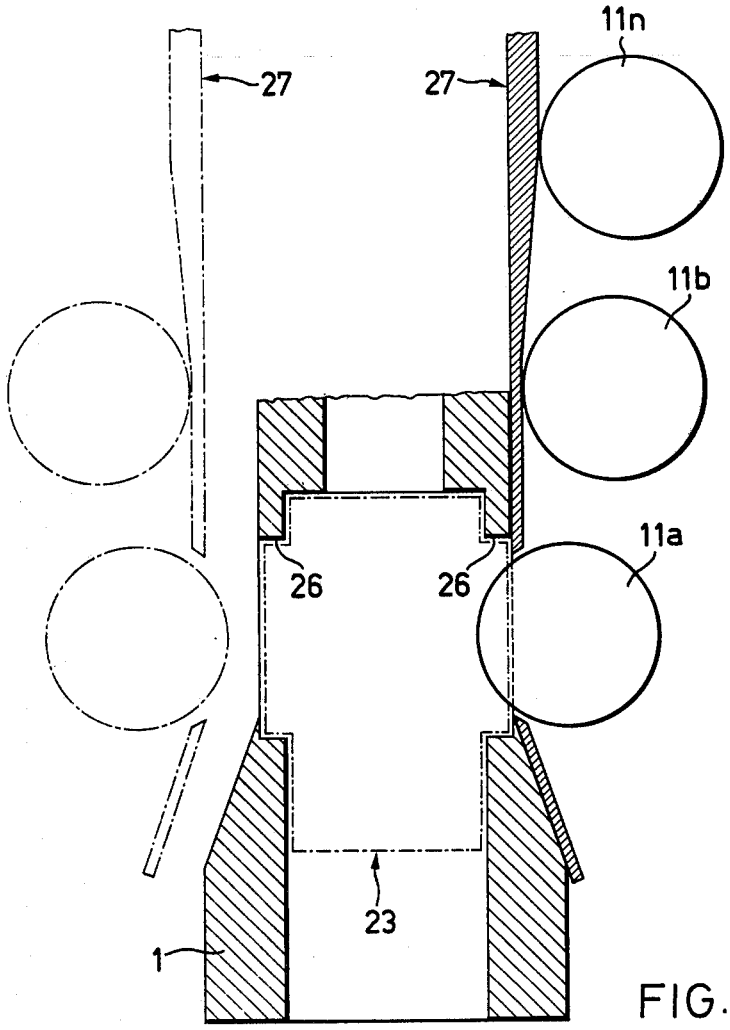
FIG. 2 is a cross-sectional view, taken substantially along the line II—II of FIG. 1.

According to the showing of FIG. 2 there are provided in the weapon housing 1 two lateral openings 26 which are situated opposite one another. To the left and right of the weapon housing 1 there is arranged a respective ammunition infeed device 27 which has only been schematically shown in FIG. 2. One such ammunition infeed device 27 is located, in each instance, in a cartridge infeed position, for instance as shown at the right-hand side of FIG. 2, while the other ammunition infeed device 27 is located in a perparatory position. In FIG. 2 the breechblock body 23 has been shown schematically in phantom line position, while the cartridges have been designated by reference characters 11*a* to 11*n*.

Also in the showing of FIG. 1 there is illustrated the cartridge 11*a*. The openings 26 are limited at the front by the shoulder or projection 1*a*. Between the shoulder surface 21 and the front end of the cartridge 11*a*, which is still located in the cartridge or ammunition infeed device (FIG. 2) arranged fixedly at the gun cradle or mount, there is present a spacing c corresponding to the return movement of the weapon for the position shown in FIG. 1.

Having now had the benefit of the foregoing description of the breechblock for an automatic firing weapon as proposed by the invention, its mode of operation will be considered and is as follows:

The cartridge 11*a* which arrives at the opening 26, upon forward travel of the breechblock body 23 is engaged thereby and shoved forwardly into the weapon barrel 7, and wherein the surfaces 25 during guiding of the cartridges assists such into their central position. The breechblock body 23 which shoves the cartridge 11*a* must move, in relation to the weapon housing 1, through a path of travel which is governed by the spacing a of the rear shoulder surface 21 from the rear end face or surface 8 of the weapon barrel 7. Since the locking elements 13 in each case have a rear projection 13*b* which is provided with the support surface 16, yet the locking surfaces 15 however are arranged in each case at the front part 13*a* of the related locking element 13 and thus are disposed forwardly of the support surfaces 16, it is possible—with unchanged mass of the breechblock head 2, the control element 3 and for the relative displacement thereof—to reduce this spacing or distance a, and thus, the required path of the breechblock body 23. Upon compliance with the spacing magnitude b, needed for reasons of strength, between the rear edge 24 of the latching or catch surface 14 and the shoulder surface 21 there is thus reduced the spacing a inasmuch as the latch or catch surface 14 can be constructed closer to the rear end of the weapon barrel 7 since the locking surface 15 at the related locking element 13 also is situated closer to the front end surface 10 of the breechblock head 2. Due to shortening of the path of travel of the breechblock there is realized a greater firing speed or cadence of the weapon. It is thus possible to reduce the total length of the weapon and therefore likewise also the weight of the weapon.

A further advantage which is beneficially realized, in contrast to the state-of-the-art breechblocks, resides from the modified lever conditions at the locking elements 13. As is known the force of the gas pressure prevailing after firing a shot is transmitted by means of the breechblock head 2 and the locking elements 13 to the latch surfaces 14 of the breechblock housing 1 or the locking or blocking body 6. The angle which the latch surfaces 14 enclose with the lengthwise axis of the weapon, is selected in known manner such that the latch surfaces 14 do not act in a self-locking manner upon the locking elements 13. Therefore, the locking elements 13, under the action of the loading forces, are inwardly pressed and bear at the support surfaces 18 of the control element 3. The lever arm and the moment of such force, striving to inwardly rock the locking elements 13, with the inventive construction of locking elements 13 is smaller owing to the forward positioning of the locking surfaces 15 closer to the locking element-pivot axis, so that also the support force transmitted by the control element 3 at the locking elements 13 is smaller. In this way the wear of the mutually sliding support surfaces 16 and 18 of the locking elements 13 and the control element 3 is beneficially reduced.

While there are shown and described present preferred embodiments of the invention, it is to be distinctly understood that the invention is not limited thereto, but may be otherwise variously embodied and practiced within the scope of the following claims. ACCORDINGLY, What I claim is:

1. A breechblock for an automatic firing weapon, comprising:

a breechblock housing;

a breechblock body displaceably mounted in said breechblock housing;

said breechblock body comprising a breechblock head and a control element;

at least one locking element structured as a single-arm lever;

said locking element being pivotably mounted at the breechblock head;

said locking element having a locking surface and a support surface;

said breechblock housing being provided with a latch surface;

the locking surface of the locking element, in a forward firing position of the breechblock body, engaging with said latch surface of the breechblock housing and the support surface being engaged by the control element;

said locking element having a front part containing the pivot axis of said locking element and a rear projection;

said locking surface being provided at the front part and the support surface at the rear projection;

the locking surface having a rear edge which is arranged in spaced relationship from and forwardly of the rear end of the support surface; and said front part of the locking element has a greater width than the rear projection.

* * * * *